US009657436B2

(12) United States Patent
Iverson et al.

(10) Patent No.: US 9,657,436 B2
(45) Date of Patent: May 23, 2017

(54) LIQUID AND SOIL REPELLENT COMPOSITIONS FOR FIBERS

(71) Applicant: INVISTA NORTH AMERICA S.A R.L., Wilmington, DE (US)

(72) Inventors: Isaac K Iverson, Columbia, SC (US); James E Copenhafer, Hockessin, DE (US); Charles N Kelcey, Lugoff, SC (US); Michelle A Ivy, Columbia, SC (US)

(73) Assignee: INVISTA North America S.á.r.l., Wilmington, DE (US)

( * ) Notice: Subject to any disclaimer, the term of this patent is extended or adjusted under 35 U.S.C. 154(b) by 0 days.

(21) Appl. No.: 14/375,867

(22) PCT Filed: Jan. 31, 2013

(86) PCT No.: PCT/US2013/024092

§ 371 (c)(1),
(2) Date: Jul. 31, 2014

(87) PCT Pub. No.: WO2013/116486

PCT Pub. Date: Aug. 8, 2013

(65) Prior Publication Data

US 2015/0004351 A1 Jan. 1, 2015

Related U.S. Application Data

(60) Provisional application No. 61/592,692, filed on Jan. 31, 2012, provisional application No. 61/600,755, filed on Feb. 20, 2012.

(51) Int. Cl.

| | |
|---|---|
| ***D06M 11/00*** | (2006.01) |
| ***D06M 11/77*** | (2006.01) |
| ***D06M 15/277*** | (2006.01) |
| ***D06M 13/188*** | (2006.01) |
| ***D06M 15/576*** | (2006.01) |
| ***D06M 23/08*** | (2006.01) |
| ***D06M 15/227*** | (2006.01) |
| ***D06M 13/02*** | (2006.01) |
| ***D06M 15/53*** | (2006.01) |

(52) U.S. Cl.

CPC ..... *D06M 11/77* (2013.01); *D06M 11/00* (2013.01); *D06M 13/02* (2013.01); *D06M 13/188* (2013.01); *D06M 15/227* (2013.01); *D06M 15/277* (2013.01); *D06M 15/53* (2013.01); *D06M 15/576* (2013.01); *D06M 23/08* (2013.01); *D06M 2200/01* (2013.01); *D06M 2200/10* (2013.01); *Y10T 428/23921* (2015.04); *Y10T 428/2933* (2015.01); *Y10T 442/2279* (2015.04)

(58) Field of Classification Search

CPC ..... D06M 11/00; D06M 11/77; D06M 15/53; D06M 15/277; D06M 15/227; D06M 15/576; D06M 13/188; D06M 13/02; D06M 23/08; D06M 2200/01; D06M 2200/10

See application file for complete search history.

(56) References Cited

U.S. PATENT DOCUMENTS

| | | | | |
|---|---|---|---|---|
| 3,396,182 | A | 8/1968 | Guenthner et al. | |
| 3,574,791 | A | 4/1971 | Sherman et al. | |
| 3,847,637 | A | 11/1974 | Luszczak | |
| 4,024,178 | A | 5/1977 | Landucci | |
| 4,147,851 | A | 4/1979 | Raynolds | |
| 4,540,497 | A | 9/1985 | Chang et al. | |
| 4,606,737 | A | 8/1986 | Stern | |
| 5,576,095 | A | 11/1996 | Ueda et al. | |
| 8,057,693 | B1 | 11/2011 | Ford et al. | |
| 2003/0130139 | A1* | 7/2003 | Komiyama | C10M 141/00 508/161 |
| 2005/0204477 | A1* | 9/2005 | Casella | C11D 3/001 8/115.51 |
| 2005/0272333 | A1 | 12/2005 | Wang et al. | |
| 2006/0089288 | A1* | 4/2006 | Horton | C11D 1/835 510/421 |
| 2010/0215894 | A1 | 8/2010 | Iverson et al. | |
| 2011/0311757 | A1 | 12/2011 | Iverson et al. | |

FOREIGN PATENT DOCUMENTS

| | | | |
|---|---|---|---|
| JP | 2008-542567 | A | 11/2008 |
| WO | 2013/116486 | A1 | 8/2013 |

OTHER PUBLICATIONS

International Search Report and Written Opinion Received for PCT Applcaton No. PCT/US2013/024092 mailed on Jun. 2, 2013, 9 pages.

International Preliminary Report on Patentability Report Received for PCT Patent Application No. PCT/US2013/024092, mailed on Aug. 14, 2014, 7 pages.

Extended European Search Report Received for EP Patent Application No. 13743033.6, mailed on Nov. 6, 2015, 6 pages.

* cited by examiner

*Primary Examiner* — Anthony J Green

(74) *Attorney, Agent, or Firm* — Bridget C. Sciamanna

(57) ABSTRACT

Included are compositions for fibers which include a clay nanoparticle and a wax. The composition provides the fibers with oil and water repellency.

21 Claims, No Drawings

LIQUID AND SOIL REPELLENT COMPOSITIONS FOR FIBERS

BACKGROUND OF THE INVENTION

Field of the Invention

Included are liquid and soil repellent compositions for application on fiber and methods of applying these compositions. The liquid repellent composition includes a wax and the soil repellent composition includes at least one clay nanoparticle.

Description of the Related Art

Textiles that include fiber such as carpet can be exposed to a variety of different substances that can stain and ultimately diminish the appearance of carpet. The substances can be hydrophilic and/or hydrophobic in nature.

Stain and soil repellent chemicals are often applied during the production of textiles including carpets and textile products used for upholstery, bedding, and other textiles. Anti-soil treatments of such textiles have primarily been based on variations of highly fluorinated polymers which, among other effects, tend to reduce the surface energy of the fibers resulting in a decrease in the soiling of the textiles. A considerable disadvantage of such fluorinated polymers is their high cost, owing in part to the somewhat limited raw material supplies required for their production.

Non-fluorinated polymers or materials have also been developed to treat textiles, especially carpets, to reduce soiling. Examples include silicones, silicates, and certain silsesquioxanes. However, these non-fluorinated compositions generally do not provide the same soil and water-repellent effects on textiles compared to the fluorinated polymers. They are, however, much more readily sourced from raw materials, thus further improvements using silicon-based materials is advantageous.

Recently, combinations of fluorinated polymers with non-fluorinated materials have been shown to be useful to treat nylon carpets. In certain cases, even though the carpets have shown certain soil resistance, the feel of some of these treated carpets to the hand, or "hand," (or "handle") is less pleasant than the original, untreated carpets, especially when they have also been treated with stain-resistant compositions.

A satisfactory hand, including smooth interactions between carpet fibers, is especially important for textiles such as carpets and textile products used for upholstery, bedding, and other interior applications. Increased value-in-use is associated with a luxurious tactile sensation that is preferred and desirable for these textiles. However, attempts to improve hand by the addition of non-fluorochemical topically-applied agents have been problematic because such agents tend to cause increased soiling and they generally wear or wash off quickly, rapidly losing their tactile effectiveness.

SUMMARY OF THE INVENTION

Although individual formulations exist for repelling water-based and oil-based materials, it would be desirable to have a formulation that combines liquid repellency and soil repellency to prolong the appearance and durability of carpet and other fiber-including textiles. It would be additionally advantageous for this composition to maintain or provide desired tactile properties to the treated textile. Ideally, this composition would include a soil resistant/repellent composition that reduced or removed the need for including costly fluorochemicals.

One aspect provides a composition in an aqueous dispersion including a combination of a soil repellent composition and a liquid repellent composition;

(a) the soil repellent composition including at least one clay nanoparticle component and optionally a first surfactant; and (b) the liquid repellent composition including a wax and a second surfactant.

In a further aspect this composition excludes the addition of fluorochemical. In other words, no fluorochemical is added to either the soil repellent composition or the liquid repellent composition.

Another aspect provides a method of providing soil and liquid repellency to an article including applying a composition to the article where the composition, in an aqueous dispersion, includes a combination of a soil repellent composition and a liquid repellent composition;

(a) said soil repellent composition including at least one clay nanoparticle component and a first surfactant; and (b) said liquid repellent composition including a wax and a second surfactant.

A still further aspect provides an article including fiber and a composition in an aqueous dispersion, where the aqueous dispersion combines a soil repellent composition and a liquid repellent composition;

(a) the soil repellent composition including at least one clay nanoparticle component and a first surfactant; and (b) the liquid repellent composition including a wax and a second surfactant.

DETAILED DESCRIPTION

Definitions

While mostly familiar to those versed in the art, the following definitions are provided in the interest of clarity.

Nanoparticle: A multidimensional particle in which one of its dimensions is less than 100 nm in length.

OWF (On weight of fiber): The amount of solids that were applied after drying off the solvent.

WPU (Wet Pick-up): The amount of solution weight that was applied to the fiber before drying off the solvent.

Liquid repellency: The ability of an article to avoid penetration of a liquid into the article. The liquid can include water, solvents, or hydrophobic (i.e., oil-based) materials.

Soil repellency and dry soil resistance: Terms used herein interchangeably to describe the ability to prevent dry soils from sticking to a fiber. For example, the dry soil may be dirt tracked in by foot traffic.

Alkyl: Straight or branched hydrocarbon radicals, such as methyl, ethyl, propyl, butyl, octyl, isopropyl, tert-butyl, sec-pentyl, and the like. Alkyl groups can either be unsubstituted or substituted with one or more substituents, e.g., halogen, alkoxy, aryl, arylalkyl, aralkoxy and the like. Alkyl groups include, for example, 1 to 25 carbon atoms, 1 to 8 carbon atoms, or 1 to 4 to carbon atoms.

The terms "first" and "second" are only used only for convenience to differentiate between different components of the composition and imply nothing regarding the order of addition, or require that the component be included.

The compositions of some aspects provide soil and liquid repellency to fibers, such as those in carpeting. This composition is prepared by either separately preparing a liquid repellent composition and a soil repellent composition, which are then combined or, as an alternative, the components of each of the liquid repellent composition and the soil repellent composition are combined in a single step. The soil repellent includes at least one clay nanoparticle component and optionally a first surfactant. The liquid repellent composition includes a wax and a second surfactant. Regardless of whether the liquid repellent composition and the soil repellent composition are prepared together or separately, the second surfactant, and the first surfactant (when included) are independently selected and may be the same or different. Examples of suitable components are described in greater detail hereinbelow.

The combination of the soil repellent composition and liquid repellent composition provides these desired properties to fiber. The composition may be combined by any suitable method known in the art. Advantageously, this composition can be prepared and is effective in the absence of added fluorochemicals. In other words, the composition may exclude fluorochemicals and is prepared in the absence of fluorochemicals.

The aqueous composition includes the soil repellent composition in an amount of about 1.0% to about 20.0% by weight of the composition, such as about 5% to about 10% by weight of the composition and includes the liquid repellent composition in an amount of 0.1% to about 10.0% by weight of the composition, such as about 1% to about 3% by weight of the composition.

Additives may also be included such as a preservative and/or antimicrobial agent.

The article of one aspect includes fiber and a composition in an aqueous dispersion including a combination of a soil repellent composition and a liquid repellent composition. The soil repellent composition includes at least one clay nanoparticle component and optionally a first surfactant; and the liquid repellent composition includes a wax and a second surfactant. The article may be a textile selected from the group consisting of a rug, carpet, yarn, bedding, clothing, window treatments, upholstery, and table coverings.

Another aspect provides a method for providing soil and liquid repellency to an article including applying a composition to the article wherein said composition, in an aqueous dispersion, includes a combination of a soil repellent composition and a liquid repellent composition. The soil repellent composition includes at least one clay nanoparticle component and optionally a first surfactant. The liquid repellent composition includes a wax and a second surfactant. The method may also include where the composition is applied to the surface of the article.

The Soil Repellent Composition

The soil repellent composition includes at least one clay nanoparticle component. Suitable clay nanoparticles are disclosed in U.S. Patent Application Publication No. 2011/0311757 to Iverson et al., which is incorporated herein by reference. These clay nanoparticles can be selected from the group consisting of smectites, kaolins, illites, chlorites, attapulgites, and combinations thereof. More specific examples include montmorillonite, bentonite, pyrophyllite, hectorite, saponite, sauconite, nontronite, talc, beidellite, volkonskoitevolkonskoite, vermiculite, kaolinite, dickite, antigorite, anauxite, indellite, chrysotile, bravaisite, muscovite, paragonite, biotite, corrensite, penninite, donbassite, sudoite, pennine, sepiolite, palygorskyte, and combinations thereof.

The clay nanoparticle component may be natural or synthetic. In one aspect the nanoparticle component includes synthetic hectorite. Regardless of whether the clay nanoparticle is natural or synthetic, the clay nanoparticle component may be present in an amount from about 0.01% to about 25% by weight of the combined composition. Typically, the clay nanoparticle is present in an amount of about 4% to about 38% by weight of the soil repellent composition. Examples of suitable clay nanoparticles are commercially available from Rockwood Additives Ltd under the brand name Laponite®. These include Laponite RD®, Laponite RDS®, Laponite JS®, and Laponite S482®.

Even though a fluorochemical is not needed to achieve the desired soil and liquid repellent properties, one or more may be included. For example the soil repellent composition can include a fluorochemical. A suitable fluorochemical may be derived from any of the classes specific to fluorinated matter including fluoropolymers, perfluoropolyethers (PFPEs), and side-chain-fluorinated polymers. Examples of fluoropolymers include polytetrafluoroethylene (PTFE), polyvinylidene fluoride (PVDF), polyvinyl fluoride (PVF), and polymers and copolymers of tetrafluoroethylene (TFE), hexafluoropropylene (HFP), vinylidene fluoride, and ethylene. Examples of PFPEs include polymers and copolymers of TFE and HFP polymerized in the presence of $O_2$; another example is the homopolymer of hexafluoropropylene oxide (HFPO). Examples of suitable oligomeric or polymeric fluorochemicals that may be used with the compositions of some embodiments include fluorinated allophanates, fluorinated polyacrylates, fluorinated urethanes, fluorinated oxetanes, fluorinated carbodiimides, fluorinated guanidines, perfluoropolyethers, fluorochemicals incorporating $C_2$ to $C_8$ chemistries, and combinations thereof. A fluorochemical may be charge neutral or have an associated cationic or anionic charge.

The fluorochemicals can include any liquid containing at least one dispersed or emulsified fluorine containing polymer or oligomer. The liquid can also contain other nonfluorine containing compounds. Examples of fluorochemical compositions used in the disclosed composition include anionic, cationic, or nonionic fluorochemicals such as the fluorochemical allophanates disclosed in U.S. Pat. No. 4,606,737; fluorochemical polyacrylates disclosed in U.S. Pat. Nos. 3,574,791 and 4,147,851; fluorochemical urethanes disclosed in U.S. Pat. No. 3,398,182; fluorochemical carbodiimides disclosed in U.S. Pat. No. 4,024,178; and fluorochemical guanidines disclosed in U.S. Pat. No. 4,540,497. The above listed patents are hereby incorporated by reference in their entirety. A short chain fluorochemical with less than or equal to six fluorinated carbons per fluorinated side-chain bound to the active ingredient polymer or surfactant can also be used. The short chain fluorochemicals can be made using fluorotelomer raw materials or by electrochemical fluorination. Another fluorochemical that can be used in the disclosed composition is a fluorochemical emulsion sold as Capstone RCP® from DuPont.

The disclosed soil repellency aqueous dispersion can be made using various techniques. One technique comprises contacting at least one clay nanoparticle component with water to form an aqueous clay nanoparticle solution. Aqueous solvent mixtures containing low molecular weight alcohols (such as methanol, ethanol, isopropanol, and the like) can also be used to disperse the clay. The clay nanoparticle component can be present in an amount from about 0.01% to about 25% weight in solution, including about 1% to about 20%, about 0.05% to about 15%, about 0.01% to about 5%, about 0.05% to about 5%, about 0.5% to about 5%, and about 5% to about 15%. When Laponite® is used as the clay nanoparticle, the concentration is from about 0.05% to about 25% weight in solution, including from about 0.05% to 1% w/w and from about 5% to about 15% w/w. The aqueous clay nanoparticle solution is then optionally contacted with a fluorochemical to form the soil repellency aqueous dispersion. The % elemental fluorine in the combined dispersion can be present in an amount from about 0.0001% to about 5% by weight fluorine atoms present in the dispersion, including about 0.001% to about 2%, about 0.001% to about 0.8%, about 0.005% to about 0.5%, about 0.005% to about 0.15%, about 0.01% to about 1%, about 0.025% to about 0.5%, and about 0.05% to about 0.5%. When Capstone RCP® is used as the fluorochemical, the concentration is from about 0.005% to about 0.5%, including from about 0.005% to about 0.15% depending on the wet pick-up percentage of the application to the fibers. When formulating the aqueous dispersions, the weight percent of clay nanoparticle component should remain higher than the weight percent fluorine. Typical weight percent ratios of clay nanoparticles to fluorine range from about 5000:1 to about 2:1, including about 3000:1, about 1500:1, about 1000:1, about 500:1, about 100:1, about 50:1, about 25:1, and about 10:1.

The nanoparticles provide soil repellent properties in the absence of a fluorochemical. When optionally combined with a fluorochemical, the nanoparticle acts as a fluorochemical extender allowing anti-soiling properties on the fiber at reduced fluorine levels on weight of fiber.

The Liquid Repellent Composition

The liquid repellent composition includes a wax. Suitable wax and surfactant components are disclosed in U.S. Pat. No. 8,057,693, incorporated herein by reference. The liquid repellent composition can be prepared using techniques known in the art. In one aspect, the total amount of wax present in the liquid repellent composition is from about 1% to about 40% by weight, about 5% to about 35% by weight, about 10% to about 30% by weight, or about 15% to about 25% by weight of the liquid repellent composition.

The wax component is not limited and known wax components can be used. Examples of waxes useful herein include, but are not limited to, vegetable waxes such as carnauba wax, haze wax, ouricury wax and esparto wax; animal waxes such as bees wax, insect wax, shellac wax and spermaceti wax; petroleum waxes such as paraffin wax, microcrystal wax, also known as microcrystalline wax, polyethylene wax, ester wax and oxidized wax; mineral waxes such as montan wax, ozokerite and ceresine; modified wax, glyceride, synthetic ketone amine amide, hydrogenated wax, or any combination thereof. In other aspects, the wax component is a higher fatty acid such as palmitic acid, stearic acid, margaric acid and behenic acid; higher alcohols such as palmityl alcohol, stearyl alcohol, behenyl alcohol, margaryl alcohol, myricyl alcohol and eicosanol; higher fatty acid esters such as cetyl palmitate, myricyl palmitate, cetyl stearate and myricyl stearate; amides such as acetamide, propionic acid amide, palmitic acid amide, stearic acid amide and amide wax; higher fatty amines such as stearylamine, behenylamine and palmitylamine, or any combination thereof.

The wax may include a natural wax, a synthetic wax, or a combination thereof. Examples include a vegetable wax, an animal wax, a mineral wax, a petroleum wax, a polyoxyalkylene, or any combination thereof. In one aspect, the wax comprises paraffin wax, candellila wax, and a polyoxyalkylene such as polyethylene oxide (e.g., Carbowax™ 400). The wax may be included in an amount of about 5% to about 40% by weight of the liquid repellent composition.

Surfactants

The compositions described herein also include one or more surfactants. In one aspect, the surfactant is anionic, cationic, or neutral. In the case when two or more surfactants are used to produce the composition, the surfactants are selected such that the first and second surfactant components are compatible with one another (i.e., do not form separate phases when mixed). Examples of combinations of surfactants include anionic/anionic, nonionic/nonionic, nonionic/anionic, cationic/cationic, and cationic/nonionic.

The first surfactant and second surfactants are the same or are different. Each of the first surfactant and second surfactant are independently selected from two or more different surfactants or may be the same surfactant. The surfactants are not a mixture of a cationic surfactant and an anionic surfactant. In one aspect where the wax includes paraffin wax, candellila wax, and a polyoxyalkylene, the second surfactant comprises a salt of oleic acid.

Suitable anionic surfactants include, but are not limited to, alkali metal and (alkyl)ammonium salts of: 1) alkyl sulfates and sulfonates such as sodium dodecyl sulfate, sodium 2-ethylhexyl sulfate, and potassium dodecanesulfonate; 2) sulfates of polyethoxylated derivatives of straight or branched chain aliphatic alcohols and carboxylic acids; 3) alkylbenzene or alkylnaphthalene sulfonates and sulfates such as sodium laurylbenzene-4-sulfonate and ethoxylated and polyethoxylated alkyl and aralkyl alcohol carboxylates; 5) glycinates such as alkyl sarcosinates and alkyl glycinates; 6) sulfosuccinates including dialkyl sulfosuccinates; 7) isethionate derivatives; 8) N-acyltaurine derivatives such as sodium N-methyl-Noleyltaurate); 9) amine oxides including alkyl and alkylamidoalkyldialkylamine oxides; and 10) alkyl phosphate mono or di-esters such as ethoxylated dodecyl alcohol phosphate ester, sodium salt. Commercial examples of suitable anionic sulfonate surfactants include, for example, sodium lauryl sulfate, available as TEXAPON™ L-100 from Henkel Inc., Wilmington, Del., or as POLYSTEP™ B-3 from Stepan Chemical Co, Northfield, Ill.; sodium 25 lauryl ether sulfate, available as POLYSTEP™ B-12 from Stepan Chemical Co., Northfield, Ill.; ammonium lauryl sulfate, available as STAN-DAPOL™ A from Henkel Inc., Wilmington, Del.; and sodium dodecyl benzene sulfonate, available as SIPONATE™ DS-10 from Rhone-Poulenc, Inc., Cranberry, N.J., dialkyl sulfosuccinates, having the tradename AEROSOL™ OT, commercially available from Cytec Industries, West Paterson, N.J.; sodium methyl taurate (available under the trade designation NIKKOL™ CMT30 from Nikko Chemicals Co., Tokyo, Japan); secondary alkane sulfonates such as Hostapur™ SAS which is a Sodium (C14-C17) secondary alkane sulfonates (alpha-olefin sulfonates) available from Clariant Corp., Charlotte, N.C.; methyl-2-sulfoalkyl esters such as sodium methyl-2-sulfo(C12-16)ester and disodium 2-sulfo (C12-C16) fatty acid available from Stepan Company under the trade designation ALPHASTE™ PC48; alkylsulfoacetates and alkylsulfosuccinates available as sodium laurylsulfoacetate (under the trade designation LANTHANOL™ LAL) and disodiumlaurethsulfosuccinate (STEPANMILD™ SL3), both from Stepan Company; alkylsulfates such as ammoniumlauryl sulfate commercially available under the trade designation STEPANOL™ AM from Stepan Company, and or dodecylbenzenesulfonic acid sold under BIO-SOFT® AS-100 from Stepan Chemical Co. In one aspect, the surfactant can be a disodium alpha olefin sulfonate, which contains a mixture of C12 to C16 sulfonates. In one aspect, CALSOFT™ AOS-40 manufactured by Pilot Corp. can be used herein as the surfactant. In another aspect, the surfactant is DOWFAX 2A1 or 2G manufactured by Dow Chemical, which are alkyl diphenyl oxide disulfonates. Representative commercial examples of suitable anionic phosphate surfactants include a mixture of mono-, di- and tri-(alkyltetraglycolether)-o-phosphoric acid esters generally referred to as trilaureth-4-phosphate commercially available under the trade designation HOSTAPHAT™ 340KL from Clariant Corp., as well as PPG-5 cetyl 10 phosphate available under the trade designation CRODAPHOS™ SG from Croda Inc., Parsippany, N.J.

Commercial examples of suitable anionic amine oxide surfactants include those commercially available under the trade designations AMMONYX™ LO, LMDO, and CO, which are lauryldimethylamine oxide, laurylamidopropy-4, 5-dimethylamine oxide, and cetyl amine oxide, all from Stepan Company.

In the case of nonionic surfactants, in one aspect, the nonionic surfactants include the condensation products of a higher aliphatic alcohol, such as a fatty alcohol, containing about 8 to about 20 carbon atoms, in a straight or branched chain configuration, condensed with about 3 to about 100 moles, preferably about 5 to about 40 moles, most preferably about 5 to about 20 moles of ethylene oxide. Examples of such nonionic ethoxylated fatty alcohol surfactants are the Tergitol™ 15-S series from Union Carbide and Brij™ surfactants from ICI. Tergitol™ 15-S Surfactants include CHC15 secondary alcohol polyethyleneglycol ethers. Brij™ 97 surfactant is polyoxyethylene(10) oleyl ether; Brij™ 58 surfactant is polyoxyethylene(20) cetyl ether; and Brij™ 76 surfactant is polyoxyethylene(10) stearyl ether. Another useful class of nonionic surfactants include the polyethylene oxide condensates of one mole of alkyl phenol containing from about 6 to 12 carbon atoms in a straight or branched chain configuration, with about 3 to about 100 moles, preferably about 5 to about 40 moles, most preferably about 5 to about 20 moles of ethylene oxide to achieve the above defined HLB. Examples of nonreactive nonionic surfactants are the Igepal™ CO and CA series from Rhone-Poulenc. Igepal™ CO surfactants include nonylphenoxy poly(ethyleneoxy)ethanols. Igepal™ CA surfactants include octylphenoxy poly(ethyleneoxy)ethanols.

Another useful class of hydrocarbon nonionic surfactants include block copolymers of ethylene oxide and propylene oxide or butylene oxide with HLB values of about 6 to about 19, preferably about 9 to about 18, and most preferably about 10 to about 16. Examples of such nonionic block copolymer surfactants are the Pluronic™ and Tetronic™ series of surfactants from BASF. Pluronic™ surfactants include ethylene oxide-propylene oxide block copolymers. Tetronic™ surfactants include ethylene oxide-propylene oxide block copolymers. In other aspects, the nonionic surfactants include sorbitan fatty acid esters, polyoxyethylene sorbitan fatty acid esters and polyoxyethylene stearates having HLBs of about 6 to about 19, about 9 to about 18, and about 10 to about 16. Examples of such fatty acid ester nonionic surfactants are the Span™, Tween™, and Myrj™ surfactants from ICI. Span™ surfactants include $C_{12}$-$C_{18}$ sorbitan monoesters. Tween™ surfactants include poly(ethylene oxide) $C_{12}$-$C_{18}$ sorbitan monoesters. Myj™ surfactants include poly(ethylene oxide) stearates.

In one aspect, the nonionic surfactant can include polyoxyethylene alkyl ethers, polyoxyethylene alkyl-phenyl ethers, polyoxyethylene acyl esters, sorbitan fatty acid esters, polyoxyethylene alkylamines, polyoxyethylene alkylamides, polyoxyethylene lauryl ether, polyoxyethylene cetyl ether, polyoxyethylene stearyl ether, polyoxyethylene oleyl ether, polyoxyethylene octylphenyl ether, polyoxyethylene nonylphenyl ether, polyethylene glycol laurate, polyethylene glycol stearate, polyethylene glycol distearate, polyethylene glycol oleate, oxyethylene-oxypropylene block copolymer, sorbitan laurate, sorbitan stearate, sorbitan distearate, sorbitan oleate, sorbitan sesquioleate, sorbitan trioleate, polyoxyethylene sorbitan laurate, polyoxyethylene sorbitan stearate, polyoxyethylene sorbitan oleate, polyoxyethylene laurylamine, polyoxyethylene laurylamide, laurylamine acetate, hard beef tallow propylenediamine dioleate, ethoxylated tetramethyldecynediol, fluoroaliphatic polymeric ester, polyether-polysiloxane copolymer, and the like.

The Aqueous Composition

After combination with the liquid repellency composition, the disclosed soil repellency aqueous dispersion can be applied to various types of fibers as a surface treatment. The fiber can be any natural or synthetic fiber, including cotton, silk, wool, rayon, polyamide, acetate, olefin, acrylic, polypropylene, and polyester. The fiber can also be polyhexamethylene adipamide, polycaprolactam, Nylon 6,6 or Nylon 6. The fibers can be spun into yarns or woven into various textiles. Yarns can include low oriented yarn, partially oriented yarn, fully drawn yarn, flat drawn yarn, draw textured yarn, air-jet textured yarn, bulked continuous filament yarn, and spun staple. Textiles can include carpets and fabrics, wherein carpets can include cut pile, twisted, woven, needlefelt, knotted, tufted, flatweave, frieze, berber, and loop pile. Alternatively, the disclosed soil repellency aqueous dispersions can be applied to a yarn or textile, instead of the fiber. The disclosed soil repellency aqueous dispersions can be applied to a fiber using various techniques known in the art. Such techniques include spraying, dipping, coating, foaming, painting, brushing, and rolling the soil repellency aqueous dispersion on to the fiber. The soil repellency aqueous dispersions can also be applied on the yarn spun from the fiber or a textile made from the fiber. After application, the fiber, yarn, or textile is than heat cured at a temperature of from about 25° C. to about 200° C., including from about 150° C. to about 160° C.; and a time of from about 10 seconds to about 40 minutes, including 5 minutes.

Once applied, the clay nanoparticle component can be present in an amount from about 200 ppm to about 4000 ppm OWF, including from about 500 ppm to about 1500 ppm OWF, from about 500 ppm to about 1000 ppm OWF, from about 1000 ppm to about 1500 ppm OWF, from about 1000 ppm to about 2000 ppm OWF and from about 1500 ppm to about 2000 ppm OWF, on the surface of the fiber, yarn or textile. If included in the composition, the fluorochemical can also be present in an amount that results in an elemental fluorine content of from about 25 ppm to about 1000 ppm OWF, including from about 25 ppm to about 500 ppm OWF, from about 75 ppm to about 150 ppm OWF, from about 75 ppm to about 200 ppm OWF, from about 100 ppm to about 200 ppm OWF, and from about 140 ppm to about 150 ppm OWF, on the surface of the fiber, yarn or textile. When applying the aqueous dispersions, the OWF of the clay nanoparticle component should remain higher than the OWF of fluorine, if fluorine is indeed present. Typical OWF ratios of nanoparticles to fluorine can range from about 80:1 to about 1.5:1, including about 27:1, about 20:1, about 13:1, about 10:1, about 7.5:1, and about 5:1. Fibers, yarns, and textiles with these surface concentrations have a delta E of from about 15 to about 23 when measured using ASTM D6540.

Additional components can be added to the soil repellency composition or the liquid repellency composition disclosed above. Such components can include silicones, optical brighteners, antibacterial components, anti-oxidant stabilizers, coloring agents, light stabilizers, UV absorbers, base dyes, and acid dyes. Optical brighteners can include a triazine type, a coumarin type, a benzoxazole type, a stilbene type, and 2,2'-(1,2-ethenediyldi-4,1 phenylene)bisbenzoxazole, where the brightener is present in an amount by weight of total composition from about 0.005% to about 0.2%. Antimicrobial components can include silver containing compounds, where the antimicrobial component is present in an amount by weight of total composition from about 2 ppm to about 1%.

The features and advantages of the present invention are more fully shown by the following examples which are provided for purposes of illustration, and are not to be construed as limiting the invention in any way.

Test Method

The procedure for drum soiling was adapted from ASTM D6540 and D1776. Adapted Procedure—Orient all carpet pieces for the batch so that the pile lies down towards the left. Fluff the carpet against the pile lay and measure the L*a*b* values of the carpet with a calibrated chromameter. Condition the carpet samples at a temperature of ~70° C. with a humidity of ~65% for at least 10 hours. Mount the test specimens to the backing sheet in the drum soiler with double sided tape. Ensure that the pile lay is in the same direction for all specimens. Pour 250 g of soiled pellets (3:1000 carpet soil:zytel nylon pellets) and steel balls into the drum soiler with the carpet samples. Tumble the drum on the mill for 15 minutes. Then rotate the direction of the drum and tumble for another 15 minutes. Pull the carpet pieces off of the backing sheet, and wipe off loose pellets. Using a Dyson vacuum cleaner, vacuum each carpet sample excessively in all directions. Using a calibrated chromameter, measure the L*a*b* values of the carpet. Delta E can be calculated from the equation below where for each individual carpet sample—u represents the value from the unsoiled carpet and s represents the value from the soiled carpet.

$$\Delta E=\sqrt{(L_u-L_s)^2+(a_u-a_s)^2+(b_u-b_s)^2}$$

The procedure for water repellency testing was adapted from AATCC 193-2007. Adapted Procedure—A series of seven different solutions, which each constitute a 'level', are prepared. The compositions of these solutions are listed below.

| Solution Level | Solution Composition |
|---|---|
| 0 | 100% deionized water |
| 1 | 98% deionized water, 2% isopropylalcohol |
| 2 | 95% deionized water, 5% isopropylalcohol |
| 3 | 90% deionized water, 10% isopropylalcohol |
| 4 | 80% deionized water, 20% isopropylalcohol |
| 5 | 70% deionized water, 30% isopropylalcohol |
| 6 | 60% deionized water, 40% isopropylalcohol |

Starting with the lowest level, three drops of solution are pipetted onto the carpet surface. If at least two out of the three droplets remain above the carpet surface for 10 seconds, the carpet passes the level. The next level is then evaluated. When the carpet fails a level, the water repellency rating is determined from the number corresponding to the last level passed. A result of F (indicating failed) represents a carpet surface for which 100% deionized water cannot remain above the surface for at least 10 seconds. A result of 0 represents a carpet surface for which 100% deionized water remains above the surface for at least 10 seconds, but a solution of 98% deionized water and 2% isopropylalcohol cannot remain above the surface for at least 10 seconds.

The microcrystalline paraffin wax was obtained from IGI Wax (product number 5897A). The candelilla wax, oleic acid, triethanolamine, and polyethylene glycol 400 were all obtained from Sigma-Aldrich. The Dowfax 2A1, a surfactant, was obtained from DowCorning. The Sequapel® 417, a paraffin wax emulsion, was obtained from Omnova Solutions. S815 is a stain blocker which is obtained through INVISTA Dalton facilities.

The carpet used for testing was a 995 saxony carpet with 9/16 of an inch pile height, 13-14 stitches per inch, and 1/8 of an inch gauge. The weight of one square inch of the carpet without backing is 46 ounces.

Wax Microemulsion

A wax microemulsion solution was formulated with the four steps outlined below.

Part 1—Microcrystalline paraffin wax (142.1 g) was heated in a kettle, around 95° C., until melted. While stirring, candelilla wax (52.9 g) was slowly added to the melt, followed by oleic acid (22.7 g).

Part 2—In a separate container, water (372.7 g), Dowfax 2A1 (10.9 g), and triethanolamine (23.5 g) were added. Once the contents of the container were heated to a temperature in the range of 92-99° C., the container was very slowly poured into the kettle wax solution, while moderately stirring the wax solution. During addition, the temperature of the wax solution remained above 92° C. After the addition, the solution was allowed to stir at 92° C. for 15 minutes with a more vigorous stir rate.

Part 3—In another kettle, water (372.7 g) and polyethylene glycol 400 (2.5 g) were heated to a temperature of 92° C. The wax solution from part 2 was very slowly added to the kettle and a homogenizer was used to form a microemulsion. After 15 minutes of homogenization, the solution was allowed to cool to 32° C. The solution remained at 32° C. for 10 hours.

Part 4—After sitting at 32° C. for 10 hours, the solution had formed a thin top foam layer. The top foam layer was carefully removed from the container, and the bottom layer of the solution was filter through a GF/A glass filter.

EXAMPLES

Example 1

The following procedures were utilized to apply a wax and synthetic clay to unbacked, untreated nylon 6,6 carpet.

Wax Application

An application solution of the microemulsion wax was formulated, such that the concentration of wax resulted in either 1% weight on fiber or 2% weight on fiber for carpet samples 1-1, 1-2, 1-3, and 1-4. The pH of the application solution was dropped to a pH of 2. The carpet sample was dipped in the application solution and allowed to wick up the solution, such that the solution was evenly distributed across the carpet sample. The carpet sample was conditioned by steaming for 10 minutes and cooling to room temperature. The carpet was then rinsed with deionized water and centrifuged to remove excess water. The carpet was allowed to dry at room temperature.

Synthetic Clay Application

An aqueous 80 ppm synthetic clay solution was added to a spray container, and synthetic clay was sprayed onto carpet samples 1-1, 1-2, 1-3, and 1-5, such that 15% wet pick up with a 1.2% weight on fiber was achieved. Carpet samples 1-1 and 1-2 were dried at room temperature. Carpet samples 1-3 and 1-5 were oven cured for 10 minutes at 150° C., removed from the oven, and dried at room temperature.

| Sample Name | Sample Description | Average Delta E | % of Untreated Control | Water Repellency Results |
|---|---|---|---|---|
| 1-1 | Wax (1% owf)/Synthetic Clay Two Step Application | 15.6 | 63% | 3 |
| 1-2 | Wax (2% owf)/Synthetic Clay Two Step Application | 16.3 | 66% | 3 |
| 1-3 | Wax (2% owf)/Synthetic Clay Two Step Application | 16.6 | 67% | 3 |
| 1-4 | Control - Wax (2% owf) | 23.4 | 95% | 3 |
| 1-5 | Control - Synthetic Clay | 19.9 | 81% | 3 |
| 1-6 | Control - Untreated | 24.7 | — | 2 |

Example 2

The following procedures were utilized to apply a wax, a stain blocker, and a synthetic clay to unbacked, untreated nylon 6,6 carpet.

Wax, Stain Blocker, and Synthetic Clay Application

An application solution of the microemulsion wax was formulated, such that the concentration of wax resulted in 2% weight on fiber for carpet samples 2-1, 2-2, and 2-3. An application solution of the stain blocker was formulated, such that the concentration of stain blocker resulted in 4% weight on fiber for carpet samples 2-1 and 2-5. An application solution of the synthetic clay was formulated, such that the concentration of synthetic clay resulted in 1.2% weight on fiber for carpet sample 2-1. In cases where combinations of wax, stain blocker, or synthetic clay were applied, a two component application solution (carpet sample 2-2) or a three component application solution (carpet sample 2-1) was prepared. The pH of the application solution was dropped to a pH of 2. The carpet fiber was dipped in the application solution and allowed to wick up the solution, such that the solution was evenly distributed across the carpet sample. The carpet sample was then conditioned by steaming for 10 minutes and cooling to room temperature. The carpet was then rinsed with deionized water and centrifuged to remove excess water. The carpet was allowed to dry at room temperature.

Synthetic Clay Application

An aqueous 80 ppm synthetic clay solution was added to a spray container, and synthetic clay was sprayed onto carpet samples 2-3 and 2-4, such that 15% wet pick up with a 1.2% weight on fiber was achieved. The carpet was oven cured for 10 minutes at 150° C. The carpet was then removed from the oven and dried at room temperature.

| Sample Name | Sample Description | Average Delta E | % of Untreated Control | Water Repellency Results |
|---|---|---|---|---|
| 2-1 | Wax (2% owf)/Synthetic Clay/S815 One Application Solution (three components) | 20.0 | 77% | 2 |
| 2-2 | Wax (2% owf)/Synthetic Clay One Application Solution (two components) | 21.8 | 84% | 1 |
| 2-3 | Wax (2% owf)/Synthetic Clay Two Step Application | 18.9 | 72% | 3 |

-continued

| Sample Name | Sample Description | Average Delta E | % of Untreated Control | Water Repellency Results |
|---|---|---|---|---|
| 2-4 | Control - Synthetic Clay | 21.0 | 80% | F |
| 2-5 | Control - S815 | 20.9 | 80% | 3 |
| 2-6 | Control - Untreated | 26.1 | — | 2 |

Example 3

The following procedures were utilized to apply a wax, stain blocker, and synthetic clay to unbacked, untreated nylon 6,6 carpet.

Wax and Stain Blocker Application

An application solution of the microemulsion wax was formulated, such that the concentration of wax resulted in either 1% weight on fiber or 2% weight on fiber for carpet samples 3-1, 3-2, 3-3, and 3-4. An application solution of the stain blocker was formulated, such that the concentration of stain blocker resulted in 4% weight on fiber for carpet samples 3-1, 3-2, and 3-5. In cases where both wax and stain blocker were applied, a two component application solution (carpet samples 3-1 and 3-2) was prepared. The pH of the application solution was dropped to a pH of 2. The carpet fiber was dipped in the application solution and allowed to wick up the solution, such that the solution was evenly distributed across the carpet sample. The carpet sample was then conditioned by steaming for 10 minutes and cooling to room temperature. The carpet was then rinsed with deionized water and centrifuged to remove excess water. The carpet was allowed to dry at room temperature.

Synthetic Clay Application

An aqueous 80 ppm synthetic clay solution was added to a spray container, and synthetic clay was sprayed onto dry carpet samples (3-1, 3-2, and 3-3) or a damp carpet sample (3-4), such that 15% wet pick up with a 1.2% weight on fiber was achieved. The carpet was oven cured for 10 minutes at 150° C., removed from the oven, and dried at room temperature.

| Sample Name | Sample Description | Average Delta E | % of Untreated Control | Water Repellency Results |
|---|---|---|---|---|
| 3-1 | Wax (1% owf)/Synthetic Clay/S815 One Application Solution (two components) and Two Step Application | 15.9 | 61% | 2 |
| 3-2 | Wax (2% owf)/Synthetic Clay/S815 One Application Solution (two components) and Two Step Application | 17.8 | 68% | 2 |
| 3-3 | Wax (2% owf)/Synthetic Clay Two Step Application | 18.5 | 71% | 3 |
| 3-4 | Wax (2% owf)/Synthetic Clay Two Step Application | 17.2 | 66% | 3 |
| 3-5 | Control - S815 | 19.7 | 76% | 2 |
| 3-6 | Control - Untreated | 26.0 | — | 2 |

Example 4

The following procedures were utilized to apply a wax and synthetic clay to unbacked, untreated nylon 6,6 carpet.

The control carpet in this example is an unbacked, nylon 6,6 carpet treated with a stain blocker.

Wax Application

An application solution of Sequapel® 417 wax emulsion was formulated, such that the concentration of wax resulted in 1% weight on fiber for carpet samples 4-1 and 4-2. The pH of the application solution was dropped to a pH of 2. The carpet fiber was dipped in the application solution and allowed to wick up the solution, such that the solution was evenly distributed across the carpet sample. The carpet sample was then conditioned by steaming for 10 minutes and cooling to room temperature. The carpet was then rinsed with deionized water and centrifuged to remove excess water. The carpet was allowed to dry at room temperature.

Synthetic Clay Application

An aqueous 80 ppm synthetic clay solution was added to a spray container, and synthetic clay was sprayed onto carpet samples 4-1 and 4-2, such that 15% wet pick up with a 1.2% weight on fiber was achieved. The carpet was oven cured for 10 minutes at 150° C., removed from the oven, and dried at room temperature.

| Sample Name | Sample Description | Average Delta E | Water Repellency Results |
|---|---|---|---|
| 4-1 | Sequapel ® 417 (2% owf)/Synthetic Clay Two Step Application | 15.4 | 3 |
| 4-2 | Sequapel ® 417 (2% owf) Co-Application and Two Step Application | 17.6 | 4 |
| 4-3 | Control - stainblocker treated carpet | 14.8 | F |

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. A composition in an aqueous dispersion comprising a combination of a soil repellent composition and a liquid repellent composition;

(a) said soil repellent composition comprising at least one clay nanoparticle component and optionally a first surfactant; and (b) said liquid repellent composition comprising a wax and a second surfactant, wherein the wax comprises a mixture of paraffin wax, candellila wax, and a polyoxyalkylene.

2. The composition of claim 1, wherein the composition excludes fluorochemicals.

3. The composition of claim 1, wherein the composition is prepared in the absence of fluorochemicals.

4. The composition of claim 1, wherein said at least one clay nanoparticle component comprises at least one member selected from the group consisting of smectites, kaolins, illites, chlorites, attapulgites, and combinations thereof.

5. The composition of claim 1, wherein said at least one clay nanoparticle component comprises at least one member selected from the group consisting of montmorillonite, bentonite, pyrophyllite, hectorite, saponite, sauconite, nontronite, talc, beidellite, volkonskoite, vermiculite, kaolinite, dickite, antigorite, anauxite, indellite, chrysotile, bravaisite, muscovite, paragonite, biotite, corrensite, penninite, donbassite, sudoite, sepiolite, palygorskyte, and combinations thereof.

6. The composition of claim 1, wherein said at least one clay nanoparticle component is synthetic.

7. The composition of claim 1, wherein said at least one clay nanoparticle component is synthetic hectorite.

8. The composition of claim 1, wherein said soil repellent composition further comprises an oligomeric or polymeric fluorochemical.

9. The composition of claim 8, wherein said oligomeric or polymeric fluorochemical is selected from the group consisting of fluorinated allophanates, fluorinated polyacrylates, fluorinated urethanes, fluorinated oxetanes, fluorinated carbodiimides, fluorinated guanidines, fluorochemicals incorporating C2 to C8 chemistries, and combinations thereof.

10. The composition of claim 1, wherein said at least one clay nanoparticle component is present in an amount from about 0.01% to about 25% weight of the composition.

11. The composition of claim 1, wherein the first surfactant and second surfactants are the same.

12. The composition of claim 1, wherein the first surfactant and second surfactant are independently selected from two or more different surfactants, wherein the surfactants are not a mixture of a cationic surfactant and an anionic surfactant.

13. The composition of claim 1, wherein the first surfactant and second surfactant are independently selected from two or more different anionic surfactants.

14. The composition of claim 1, wherein the composition further comprises a preservative or antimicrobial agent.

15. The composition of claim 1, wherein the clay nanoparticle comprises about 4% to about 38% by weight of the soil repellent composition.

16. The composition of claim 1, wherein the wax is about 5% to about 40% by weight of the liquid repellent composition.

17. The composition of claim 1, wherein the second surfactant comprises a salt of oleic acid.

18. An article comprising fiber and a composition in an aqueous dispersion comprising a combination of a soil repellent composition and a liquid repellent composition;

(a) said soil repellent composition comprising at least one clay nanoparticle component and optionally a first surfactant; and (b) said liquid repellent composition comprising a wax and a second surfactant wherein the wax comprises a mixture of paraffin wax, candelilla wax, and a polyoxyalkylene.

19. The article of claim 18, wherein said article is a textile selected from the group consisting of a rug, carpet, yarn, bedding, clothing, window treatments, upholstery, and table coverings.

20. A method for providing soil and liquid repellency to an article comprising applying a composition to the article wherein said composition in an aqueous dispersion comprises a combination of a soil repellent composition and a liquid repellent composition;

(a) said soil repellent composition comprising at least one clay nanoparticle component and optionally a first surfactant; and (b) said liquid repellent composition comprising a wax and a second surfactant wherein the wax comprises a mixture of paraffin wax, candelilla wax, and a polyoxyalkylene.

21. The method of claim 20, wherein said composition is applied to the surface of the article.

* * * * *